US009604448B2

(12) United States Patent
Qi et al.

(10) Patent No.: US 9,604,448 B2
(45) Date of Patent: Mar. 28, 2017

(54) AQUEOUS INK JET BLANKET

(71) Applicant: Xerox Corporation, Norwalk, CT (US)

(72) Inventors: Yu Qi, Penfield, NY (US); Carolyn Patricia Moorlag, Mississauga (CA); Brynn Mary Dooley, Toronto (CA); Barkev Keoshkerian, Thornhill (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/962,467

(22) Filed: Dec. 8, 2015

(65) Prior Publication Data

US 2016/0089876 A1 Mar. 31, 2016

Related U.S. Application Data

(62) Division of application No. 14/230,042, filed on Mar. 31, 2014, now Pat. No. 9,242,456.

(51) Int. Cl.

| | |
|---|---|
| ***B41J 2/005*** | (2006.01) |
| ***D06M 15/19*** | (2006.01) |
| ***B41J 2/01*** | (2006.01) |

(52) U.S. Cl.

CPC ..... *B41J 2/0057* (2013.01); *B41J 2/01* (2013.01); *D06M 15/19* (2013.01); *B41J 2002/012* (2013.01); *Y10T 442/2861* (2015.04)

(58) Field of Classification Search

CPC ..... B41J 2/0057; B41J 2/01; B41J 2002/012; D06M 15/19; Y10T 442/2861

See application file for complete search history.

(56) References Cited

U.S. PATENT DOCUMENTS

| | | | | |
|---|---|---|---|---|
| 9,242,456 | B2 * | 1/2016 | Qi | B41J 2/0057 |
| 2005/0190249 | A1 | 9/2005 | Chen et al. | |
| 2009/0068481 | A1 | 3/2009 | Yamanaka et al. | |
| 2009/0142112 | A1 * | 6/2009 | Gervasi | B41J 2/17593 399/328 |
| 2009/0160920 | A1 | 6/2009 | Badesha et al. | |
| 2011/0097588 | A1 * | 4/2011 | Gervasi | B41J 2/0057 428/421 |
| 2011/0229231 | A1 | 9/2011 | Kaneko et al. | |
| 2012/0156481 | A1 | 6/2012 | Moorlag et al. | |
| 2014/0154512 | A1 | 6/2014 | Dooley et al. | |

OTHER PUBLICATIONS

Restriction Requirement for U.S. Appl. No. 14/230,042, dated Apr. 24, 2015, 6 pages.

Office Action for U.S. Appl. No. 14/230,042, dated Jul. 27, 2015, 14 pages.

Notice of Allowance and Fee(s) Due for U.S. Appl. No. 14/230,042, dated Sep. 23, 2015, 10 pages.

* cited by examiner

*Primary Examiner* — Alessandro Amari
*Assistant Examiner* — Roger W Pisha, II
(74) *Attorney, Agent, or Firm* — Hoffman Warnick LLC

(57) ABSTRACT

There is described a transfer member or blanket for use in aqueous ink jet printer. The transfer member includes a non-woven polymer fiber matrix and a polymer dispersed throughout the non-woven polymer fiber matrix. The polymer fiber matrix has a first surface energy and the polymer has a second surface energy. The difference between the first surface energy and the second surface energy is from about 30 mJ/m$^2$ to about 5 mJ/m$^2$.

20 Claims, 2 Drawing Sheets

AQUEOUS INK JET BLANKET

BACKGROUND

Field of Use

This disclosure is generally directed to ink jet transfix apparatuses and methods.

In particular, disclosed herein is a composition that improves the wetting and release capability of an aqueous latex ink in an ink jet printer.

Background

Inkjet systems in which a liquid or melt solid ink is discharged through an ink discharge port such as a nozzle, a slit and a porous film are used in many printers due to their characteristics such as small size and low cost. In addition, an ink jet printer can print not only paper substrates, but also on various other substrates such as textiles, rubber and the like.

During the printing process, various intermediate media (e.g., transfer belts, intermediate blankets or drums) may be used to transfer the formed image to the final substrate. In intermediate transfix processes, aqueous latex ink is ink jetted onto a transfer member or intermediate blanket where the ink film is dried with heat or flowing air or both. The dried image is subsequently transfixed on to the final paper substrate. For this process to operate properly, the transfer member or blanket has to satisfy two conflicting requirements—the first requirement is that ink has to spread well on the transfer member and the second requirement is that, after drying, the ink should release from the blanket. Since aqueous ink comprises a large amount of water, such ink compositions wet and spread very well on high energy (i.e., greater than 40 mJ/m$^2$) hydrophilic substrates. However, due to the high affinity to such substrates, the aqueous ink does not release well from these substrates. Silicone rubbers with low surface energy (i.e., about 20 mJ/m$^2$ or less) circumvent the release problem. However, a major drawback of the silicone rubbers is that the ink does not wet and spread on these substrates due to low affinity to water. Thus, the ideal transfer member for the transfix process would have both optimum spreading to form good quality image and optimum release properties to transfix the image to paper. While some solutions, such as adding surfactants to the ink to reduce the surface tension of the ink, have been proposed, these solutions present additional problems. For example, the surfactants result in uncontrolled spreading of the ink that causes the edges of single pixel lines to be undesirably wavy. Moreover, aqueous printheads have certain minimum surface tension requirements (i.e., greater than 20 mN/m) that must be met for good jetting performance.

Thus, there is a need for a way to provide the desired spreading and release properties for aqueous inks to address the above problems faced in transfix process.

SUMMARY

Disclosed herein is a transfer member for use in aqueous ink jet printer. The transfer member includes a non-woven polymer fiber matrix and a polymer dispersed throughout the non-woven polymer fiber matrix. The polymer fiber matrix have a first surface energy and the polymer has a second surface energy. The difference between the first surface energy and the second surface energy is from about 30 mJ/m$^2$ to about 5 mJ/m$^2$.

There is provided an ink jet printer that includes a transfer member. The transfer member includes a polymer dispersed throughout a non-woven polymer fiber matrix. The polymer fiber matrix has a first surface energy and the polymer has a second surface energy. The difference between the first surface energy and the second surface energy is from about 30 mJ/m$^2$ to about 5 mJ/m$^2$. The ink jet printer includes a print head adjacent the transfer member for ejecting aqueous ink droplets onto a surface of the transfer member to form an ink image. The ink jet printer includes a transfixing station located adjacent the transfer member and downstream from the print head. The transfixing station forms a transfixing nip with the transfer member at the transfixing station. The ink jet printer includes a transporting device for delivering a recording medium to the transfixing nip, wherein the ink image is transferred and fixed to the recording medium.

Disclosed herein is a transfer member for use in aqueous ink jet printer. The transfer member includes a non-woven polymer fiber matrix; a polymer dispersed throughout the non-woven polymer fiber matrix, and conductive particles uniformly distributed along fibers of the non-woven polymer matrix. The polymer fiber matrix has a first surface energy and the polymer has a second surface energy. The difference between the first surface energy and the second surface energy is from about 30 mJ/m$^2$ to about 5 mJ/m$^2$.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
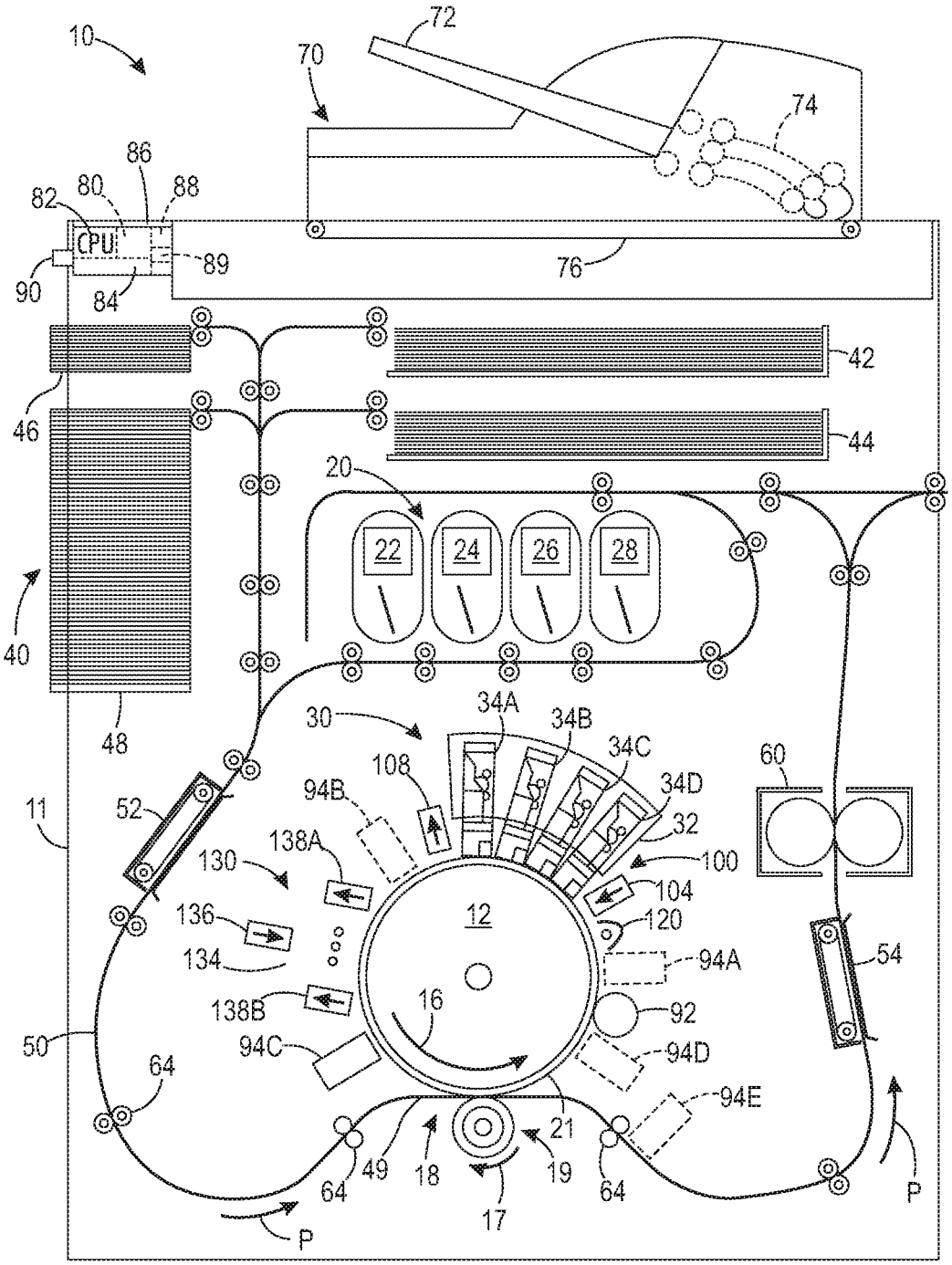
FIG. 1 is a schematic diagram illustrating an aqueous ink image printer.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The term "printhead" as used herein refers to a component in the printer that is configured with ink jet ejectors to eject ink drops onto an image receiving surface. A typical printhead includes a plurality of ink jet ejectors that eject ink drops of one or more ink colors onto the image receiving surface in response to firing signals that operate actuators in the ink jet ejectors. The ink jets are arranged in an array of one or more rows and columns. In some embodiments, the ink jets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The ink jets in the printheads eject ink drops in rows in a cross-process direction, which is perpendicular to the process direction across the image receiving surface.

In a direct printer, the printheads eject ink drops directly onto a print medium, for example a paper sheet or a continuous media web. After ink drops are printed on the print medium, the printer moves the print medium through a nip formed between two rollers that apply pressure and, optionally, heat to the ink drops and print medium. One roller, typically referred to as a "spreader roller" contacts the printed side of the print medium. The second roller, typically referred to as a "pressure roller," presses the media against the spreader roller to spread the ink drops and fix the ink to the print medium.

FIG. 1 illustrates a high-speed aqueous ink image producing machine or printer 10. As illustrated, the printer 10 is an indirect printer that forms an ink image on a surface of a transfer member 12, (also referred to as a blanket or receiving member or image member) and then transfers the ink image to media passing through a nip 18 formed with the transfer member 12. The printer 10 includes a frame 11 that supports directly or indirectly operating subsystems and components, which are described below. The printer 10 includes the transfer member 12 that is shown in the form of a drum, but can also be configured as a supported endless belt. The transfer member 12 has an outer surface 21. The outer surface 21 is movable in a direction 16, and on which ink images are formed. A transfix roller 19 rotatable in the direction 17 is loaded against the surface 21 of transfer member 12 to form a transfix nip 18, within which ink images formed on the surface 21 are transfixed onto a media sheet 49.

The transfer member 12 or blanket is formed of a material having a relatively low surface energy to facilitate transfer of the ink image from the surface 21 of the transfer member 12 to the media sheet 49 in the nip 18. Such materials are described in more detail below. A surface maintenance unit (SMU) 92 removes residual ink left on the surface of the blanket 21 after the ink images are transferred to the media sheet 49.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material such as anilox. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface 21of the blanket or transfer member 12.

Continuing with the general description, the printer 10 includes an optical sensor 94A, also known as an image-on-drum ("IOD") sensor, that is configured to detect light reflected from the surface 21 of the transfer member 12 and the coating applied to the surface 21 as the member 12 rotates past the sensor. The optical sensor 94A includes a linear array of individual optical detectors that are arranged in the cross-process direction across the surface 21 of the transfer member 12. The optical sensor 94A generates digital image data corresponding to light that is reflected from the surface 21. The optical sensor 94A generates a series of rows of image data, which are referred to as "scanlines," as the transfer member 12 rotates in the direction 16 past the optical sensor 94A. In one embodiment, each optical detector in the optical sensor 94A further comprises three sensing elements that are sensitive to frequencies of light corresponding to red, green, and blue (RGB) reflected light colors. The optical sensor 94A also includes illumination sources that shine red, green, and blue light onto the surface 21. The optical sensor 94A shines complementary colors of light onto the image receiving surface to enable detection of different ink colors using the RGB elements in each of the photodetectors. The image data generated by the optical sensor 94A is analyzed by the controller 80 or other processor in the printer 10 to identify the thickness of ink image and wetting enhancement coating (explained in more detail below) on the surface 21 and the area coverage. The thickness and coverage can be identified from either specular or diffuse light reflection from the blanket surface and coating. Other optical sensors, such as 94B, 94C, and 94D, are similarly configured and can be located in different locations around the surface 21 to identify and evaluate other parameters in the printing process, such as missing or inoperative ink jets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also can include a surface energy applicator 120 positioned next to the surface 21 of the transfer member 12 at a position immediately prior to the surface 21 entering the print zone formed by printhead modules 34A-34D. The surface energy applicator 120 can be, for example, corona discharge unit, an oxygen plasma unit or an electron beam unit. The surface energy applicator 120 is configured to emit an electric field between the applicator 120 and the surface 21 that is sufficient to ionize the air between the two structures and apply negatively charged particles, positively charged particles, or a combination of positively and negatively charged particles to the surface 21 or the transfer member. The electric field and charged particles increase the surface energy of the blanket surface and are described in more detail below. The increased surface energy of the surface 21 or transfer member 12 enables the ink drops subsequently ejected by the printheads in the modules 34A-34D to adhere to the surface 21 or transfer member 12 and coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow helps prevent evaporated solvents and water in the ink from condensing on the printhead and helps attenuate heat in the print zone to reduce the likelihood that ink dries in the ink jets, which can clog the ink jets. The airflow management system 100 can also include sensors to detect humidity and temperature in the print zone to enable more precise control of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the intermediate transfer member 12 and ejects ink drops onto the surface 21. A printhead module can include a single printhead or a plurality of printheads configured in a staggered arrangement. Each printhead module is operatively connected to a frame (not shown) and aligned to eject the ink drops to form an ink image on the surface 21. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the surface 21 exits the print zone, the image passes under an image dryer 130. The image dryer 130 includes an infrared heater 134, a heated air source 136, and air returns 138A and 138B. The infrared heater 134 applies infrared heat to the printed image on the surface 21 of the transfer member 12 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In one embodiment, the fusing device 60 adjusts a gloss level of the printed images that are formed on the print medium. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the surface 21 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the surface 21 of the transfer member 12 to the media substrate within the transfix nip 18.

In some printing operations, a single ink image can cover the entire surface 21 (single pitch) or a plurality of ink images can be deposited on the surface 21 (multi-pitch). In a multi-pitch printing architecture, the surface 21 of the transfer member 12 (also referred to as image receiving member) can be partitioned into multiple segments, each segment including a full page image in a document zone (i.e., a single pitch) and inter-document zones that separate multiple pitches formed on the surface 21. For example, a two pitch image receiving member includes two document zones that are separated by two inter-document zones around the circumference of the surface 21. Likewise, for example, a four pitch image receiving member includes four document zones, each corresponding to an ink image formed on a single media sheet, during a pass or revolution of the surface 21.

Once an image or images have been formed on the surface under control of the controller 80, the illustrated ink jet printer 10 operates components within the printer to perform a process for transferring and fixing the image or images from the surface 21 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the surface 21 of transfer member 12. The transfix roller 19 applies pressure against the back side of the recording media 49 in order to press the front side of the recording media 49 against the surface 21 of the transfer member 12. Although the transfix roller 19 can also be heated, in the embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the transfer member 12 onto the media sheet 49.

The rotation or rolling of both the transfer member 12 and transfix roller 19 not only transfixes the images onto the media sheet 49, but also assists in transporting the media sheet 49 through the nip. The transfer member 12 continues to rotate to continue the transfix process for the images previously applied to the coating and blanket 21.

As shown and described above the transfer member 12 or image receiving member initially receives the ink jet image. After ink drying, the transfer member 12 releases the image to the final print substrate during a transfer step in the nip 18. The transfer step is improved when the surface 21 of the transfer member 12 has a relatively low surface energy. However, a surface 21 with low surface energy works against the desired initial ink wetting (spreading) on the transfer member 12. Unfortunately, there are two conflicting requirements of the surface 21 of transfer member 12. The first aims for the surface to have high surface energy causing the ink to spread and wet (i.e. not bead-up). The second requirement is that the ink image once dried has minimal attraction to the surface 21 of transfer member 12 so as to achieve maximum transfer efficiency (target is 100%), this is best achieved by minimizing the surface 21 surface energy.

In transfix processes, as shown in FIG. 1, an aqueous ink at room temperature (i.e., 20-27° C.) is jetted by onto the surface of transfer member 12, also referred to as a blanket. After jetting, the transfer member 12 moves to a heater zone 136 where the ink is dried and then the dried image is transfixed onto recording medium 49 in transfix nip 19. The transfer member 12 is also referred to as intermediate media, blanket, intermediate transfer member and imaging member.

The transfer member 12 can be of any suitable configuration. Examples of suitable configurations include a sheet, a film, a web, a foil, a strip, a coil, a cylinder, a drum, an endless strip, a circular disc, a drelt (a cross between a drum and a belt), a belt including an endless belt, an endless seamed flexible belt, and an endless seamed flexible imaging belt. The transfer member 12 can be a single layer or multiple layers.

Disclosed herein is transfer member or blanket including a material composite which includes an electrospun nonwoven fiber network filled with a polymer and thermally conductive fillers distributed along the fiber network. The transfer member surface has variable surface energy due to difference in surface energy between electrospun fiber material and the filling polymer. As a result, the blanket surface has well-defined low and high surface energy domains to provide dual function for wetting aqueous ink and transferring dried ink to the substrate.

The electrospun fiber network provides a well-defined substrate used to create the variable surface energy domain. The electrospun fiber network serves a template or support for well-distributed thermally conductive fillers. The aligned thermally conductive fillers provide heat conductivity at low threshold loadings. In addition, the electrospun fiber template enables uniformly distribution of thermally conductive fillers in the coating layer without the need for reformulation of the dispersion for various filling polymer matrix.

The composite made from electrospun fabrics filled with polymers and thermally conductive additives. The composite has variable surface energies. The electrospun fiber material and the filling polymer have different surface energies creating distinct domains on the surface. In embodiments, the electrospun fiber material is hydrophilic and the filling polymer is hydrophobic. In embodiments, the electrospun fiber material is hydrophobic and the filling polymer is hydrophilic.

In embodiments, the high surface area domains have surface energies of greater than 30 $mJ/m^2$, or from about 30 $mJ/m^2$ to about 60 $mJ/m^2$, or from about 30 $mJ/m^2$ to about 40 $mJ/m^2$, or from about 35 $mJ/m^2$ to about 40 $mJ/m^2$.

In embodiments, the low surface area domains have surface energies of less than 30 $mJ/m^2$, or from about 29 $mJ/m^2$ to about 15 $mJ/m^2$, or from about 25 $mJ/m^2$ to about 20 $mJ/m^2$.

In embodiments, the difference between the higher surface energy domains and the low surface energy domains is from about or from about 30 $mJ/m^2$ to about 5 $mJ/m^2$, or from about 25 $mJ/m^2$ to about 10 $mJ/m^2$, or from about 20 $mJ/m^2$ to about 10 $mJ/m^2$.

In embodiments, the electrospun fiber material constitutes from about 5 weight percent to about 95 weight percent of the blanket. In embodiments, the electrospun fiber material constitutes from about 10 weight percent to about 80 weight percent of the blanket, or from about 30 weight percent to about 75 weight percent of the blanket.

In embodiments, the polymer constitutes from about 5 weight percent to about 95 weight percent of the blanket. In embodiments, the polymer constitutes from about 10 weight percent to about 80 weight percent of the blanket, or from about 30 weight percent to about 75 weight percent of the blanket.

In embodiments, the conductive particles constitutes from about 0.5 weight percent to about 30 weight percent of the blanket. In embodiments, the conductive particles constitute from about 1 weight percent to about 20 weight percent of the blanket, or form about 3 weight percent to about 15 weight percent of the blanket.

Thermally conductive fillers are distributed along the electrospun fiber network. The electrospun fiber network functions as both a template for the thermally conductive additive and the electrospun fiber network reinforces the blanket. The electrospun fiber template enables uniform distribution of graphene nanoparticles or other conductive particles in the coating layer which eliminates the need for a separate dispersion with the desired filling polymers.

Figure 2:
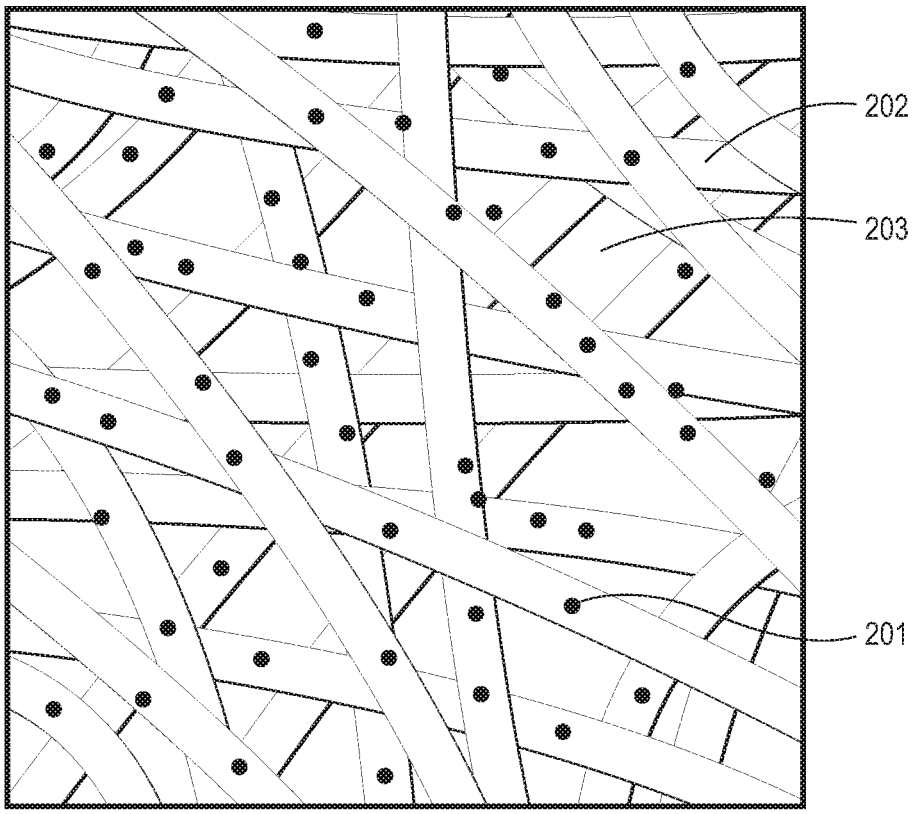
FIG. 2 shows the surface of the aqueous ink jet blanket disclosed herein.

Described herein is a blanket material that can effectively wet and transfer the ink to the substrate. This composite blanket material can be made by electrospinning a fiber mat onto a blanket substrate followed by filling a dispersion of thermally conductive filler. After removal of the dispersion liquid, a polymer solution is coated into the fiber mat by flow-coating or dip-coating process. Upon drying off the solvent, the resulting material has the conductive particles distributed along the fiber networks and the polymer filled into the fiber mat as shown in FIG. 2. The thermally conductive additive 201 is distributed along the polymer fibers 202 of the electrospun non-woven mat. Polymer 203 is distributed in throughout the of the electrospun non-woven mat. In embodiments the conductive additive can be incorporated into the fiber by co-axial electrospinning process with a filler dispersion in the core channel and the polymer solution in the shell channel. As a result, the filler is deposited along the fiber network.

Depending on the materials selected for the polymer fibers and polymer, variable surface energy domains are generated on the coating. By design, when the fiber material is selected to be high surface energy, the low surface energy material is chosen for the filling polymer, and vice versa.

Examples of high surface energy materials include polyurethane, polyamides, polyimides, polyesters, polyurea, polyethers, and the likes.

Examples of the low surface energy materials include fluoropolymers, polysiloxane, fluorosilicone, organosiloxne and their fluorinated derivatives.

Examples of the thermally conductive additives include carbon-based materials such as carbon nanotubes, carbon fibers, carbon black, graphene, graphite; inorganic materials such as alumina particles, boron nitride nanoparticles and nanotubes, silica carbide particles, aluminum nitride, and zinc oxide particles; metal-based materials such as silver, copper and nickel.

A method for manufacturing a blanket disclosed herein includes an electrospinning process to produce non-woven fiber mats with high performance polymers. A flow-coating process is used to fill in the fiber mat with thermally conductive filler dispersion and then a desired polymer solution is coated and cured. By selecting the proper fiber and filling polymer materials, the blanket with variable surface energy is fabricated.

Nonwoven fabrics are broadly defined as sheet or web structures bonded together by entangling fiber or filaments (and by perforating films) mechanically, thermally or chemically. They include flat, porous sheets that are made directly from separate fibers or from molten plastic or plastic film. They are not made by weaving or knitting and do not require converting the fibers to yarn.

Electrospinning uses an electrical charge to draw very fine (typically on the micro or nano scale) fibers from a liquid. The charge is provided by a voltage source. The process does not require the use of coagulation chemistry or high temperatures to produce solid threads from solution. This makes the process particularly suited to the production of fibers using large and complex molecules such as polymers. When a sufficiently high voltage is applied to a liquid droplet, the body of the liquid becomes charged, and electrostatic repulsion counteracts the surface tension and the droplet is stretched. At a critical point a stream of liquid erupts from the surface. This point of eruption is known as the Taylor cone. If the molecular cohesion of the liquid is sufficiently high, stream breakup does not occur and a charged liquid jet is formed.

Electrospinning provides a simple and versatile method for generating ultrathin fibers from numerous polymers. To date, numerous polymers with a range of functionalities have been electospun as nanofibers. In electrospinning, a solid fiber is generated as the electrified jet (composed of a highly viscous polymer solution with a viscosity range of from about 1 to about 400 centipoises, or from about 5 to about 300 centipoises, or from about 10 to about 250 centipoises) is continuously stretched due to the electrostatic repulsions between the surface charges and the evaporation of solvent. Suitable solvents include dimethylformamide, dimethylacetamide, 1-Methyl-2-pyrrolidone, tetrahydrofuran, a ketone such as acetone, methylethylketone, dichloromethane, an alcohol such as ethanol, isopropyl alcohol, water and mixtures thereof. The weight percent of the polymer in the solution ranges from about 1 percent to about 60 percent, or from about 5 percent to about 55 percent to from about 10 percent to about 50 percent.

In embodiments, a the core with a sheath is suitable for the non-woven matrix layer.

In embodiments, the electrospun fibers can have a diameter ranging from about 5 nm to about 50 μm, or ranging from about 50 nm to about 20 μm, or ranging from about 100 nm to about 1 μm. In embodiments, the electrospun fibers can have an aspect ratio about 100 or higher, e.g., ranging from about 100 to about 1,000, or ranging from about 100 to about 10,000, or ranging from about 100 to about 100,000. In embodiments, the non-woven fabrics can be non-woven nano-fabrics formed by electrospun nanofibers having at least one dimension, e.g., a width or diameter, of less than about 1000 nm, for example, ranging from about 5 nm to about 500 nm, or from 10 nm to about 100 nm. In embodiments, the non-woven fibers comprise from about 10 weight percent to about 50 weight percent of the release layer. In embodiments, the non-woven fibers comprise from about 15 weight percent to about 40 weight percent, or from about 20 percent to about 30 weight percent of the release layer.

In an embodiment core-sheath polymer fiber can be prepared by co-axial electrospinning of polymer core and the polymer sheath to form the non-woven core-sheath polymer fiber layer.

The fuser topcoat is fabricated by applying the polymer fibers onto the intermediate layer of a fuser substrate by an electrospinning process. Electrospinning uses an electrical charge to draw very fine (typically on the micro or nano scale) fibers from a liquid. The charge is provided by a voltage source. The process does not require the use of coagulation chemistry or high temperatures to produce solid threads from solution. This makes the process particularly suited to the production of fibers using large and complex molecules such as polymers. When a sufficiently high voltage is applied to a liquid droplet, the body of the liquid becomes charged, and electrostatic repulsion counteracts the surface tension and the droplet is stretched. At a critical point a stream of liquid erupts from the surface. This point of eruption is known as the Taylor cone. If the molecular cohesion of the liquid is sufficiently high, stream breakup does not occur and a charged liquid jet is formed.

After providing the non-woven fibers on the substrate, the conductive particles, such as graphene particles are deposited along the fibers in a uniform manner by coating a conductive particle dispersion and removing the solvent.

In embodiments, graphene particles can be employed in the dispersion. In an embodiment, the graphene particles can include graphene, graphene platelets and mixtures thereof. Graphene particles have a width of from about 0.5 microns to about 10 microns. In embodiments the width can be from about 1 micron to about 8 microns, or from about 2 microns to about 5 microns. Graphene particles have a thickness of from about 1 nanometer to about 50 nanometers. In embodiments the thickness can be from about 2 nanometers to about 8 nanometers, or from about 3 nanometers to about 6 nanometers. In an embodiment, graphene particles can have a relatively large per unit surface area, such as, for example, about 120 to 150 $m^2/g$. Such graphene-comprising particles are well known in the art.

The conductive particles are dispersed in a solvent including water, and any organic solvents, toluene, hexane, cyclohexane, heptane, tetrahydrofuran, ketones, such as methyl ethyl ketone, methyl isobutyl ketone, cyclohexanone, N-Methylpyrrolidone (NMP); amides, such as dimethylformamide (DMF); N,N'-dimethylacetamide (DMAc), sulfoxides, such as dimethyl sulfoxide; alcohols, ethers, esters, hydrocarbons, chlorinated hydrocarbons, and mixtures of any of the above. The solid content of the dispersion of conductive particles is from about 0.1 weight percent to about 10 weight percent, or in embodiments from about 0.5 weight percent to about 5 weight percent of from about 1 weight percent to about 3 weight percent.

The conductive dispersion may further comprise a stabilizer selected from the group consisting of non-ionic surfactants, ionic surfactants, polyacids, polyamines, polyelectrolytes, and conductive polymers. More specifically the stabilizer includes polyacrylic acid, copolymer of polyacrylic acid, polyallylamine, polyethylenimine, polydiallyldimethylammonium chloride), poly(allylamine hydrochloride), poly(3,4-ethylenedioxythiophene), poly(3,4-ethylenedioxythiophene) complexes with a polymer acid, Nafion (a sulfonated tetrafluoroethylene), gum arabic, and or chitosan. The amount of stabilizer in the conductive dispersion formulation ranges from about 0.1 percent to about 200 percent by weight of conductive particles, or from about 0.5 percent to about 100 percent by weight of conductive particles, or from about 1 percent to about 50 percent by weight of conductive particles.

A polymer coating is provided throughout the electrospun fibers having deposited conductive particles. The polymer coating composition can include, an effective solvent, in order to disperse the polymer that are known to one of ordinary skill in the art.

Contact angle measurements are an effective way characterize a transfer blanket surface, as the metrics help depict how the aqueous ink will wet out on the surface, and transfer to another surface, in embodiments, the contact angle of the ink on the intermediate blanket is from about 25° to about 40°, or from about 29° to about 36°, or from about 30° to about 35°.

Overall the durometer of the single or multilayer blanket is important, as the increasingly conformable nature of the blanket can improve pressure on individual or localized areas of ink, increasing the transfer efficiency with more contact between paper and ink in the transfer nip In embodiments, the transfer member 12 can have a thickness of from about 20 micron to about 5 mm, or from about 100 microns to about 4 mm, or from about 500 microns to about 3 mm.

The ink compositions that can be used with the present embodiments are aqueous-dispersed polymer or latex inks. Such inks are desirable to use since they are water-based inks that are said to have almost the same level of durability as solvent inks. In general, these inks comprise one or more polymers dispersed in water. The inks disclosed herein also contain a colorant. The colorant can be a dye, a pigment, or a mixture thereof. Examples of suitable dyes include anionic dyes, cationic dyes, nonionic dyes, zwitterionic dyes, and the like. Specific examples of suitable dyes include food dyes such as Food Black No.1, Food Black No.2, Food Red No. 40, Food Blue No.1, Food Yellow No.7, and the like, FD & C dyes, Acid Black dyes (No.1, 7, 9, 24, 26, 48, 52, 58, 60, 61, 63, 92, 107, 109, 118, 119, 131, 140, 155, 156, 172, 194, and the like), Acid Red dyes (No. 1, 8, 32, 35, 37, 52, 57, 92, 115, 119, 154, 249, 254, 256, and the like), Acid Blue dyes (No. 1, 7, 9, 25, 40, 45, 62, 78, 80, 92, 102, 104, 113, 117, 127, 158, 175, 183, 193, 209, and the like), Acid Yellow dyes (No. 3, 7, 17, 19, 23, 25, 29, 38, 42, 49, 59, 61, 72, 73, 114, 128, 151, and the like), Direct Black dyes (No. 4, 14, 17, 22, 27, 38, 51, 112, 117, 154, 168, and the like), Direct Blue dyes (No. 1, 6, 8, 14, 15, 25, 71, 76, 78, 80, 86, 90, 106, 108, 123, 163, 165, 199, 226, and the like), Direct Red dyes (No. 1, 2, 16, 23, 24, 28, 39, 62, 72, 236, and the like), Direct Yellow dyes (No. 4, 11, 12, 27, 28, 33, 34, 39, 50, 58, 86, 100, 106, 107, 118, 127, 132, 142, 157, and the like), Reactive Dyes, such as Reactive Red Dyes (No. 4, 31, 56, 180, and the like), Reactive Black dyes (No. 31 and the like), Reactive Yellow dyes (No. 37 and the like); anthraquinone dyes, monoazo dyes, disazo dyes, phthalocyanine derivatives, including various phthalocyanine sulfonate salts, aza (18)annulenes, formazan copper complexes, triphenodioxazines, and the like; and the like, as well as mixtures thereof. The dye is present in the ink composition in any desired or effective amount, in one embodiment from about 0.05 to about 15 percent by weight of the ink, in another embodiment from about 0.1 to about 10 percent by weight of the ink, and in yet another embodiment from about 1 to about 5 percent by weight of the ink, although the amount can be outside of these ranges.

Examples of suitable pigments include black pigments, white pigments, cyan pigments, magenta pigments, yellow pigments, or the like. Further, pigments can be organic or inorganic particles. Suitable inorganic pigments include, for example, carbon black. However, other inorganic pigments may be suitable, such as titanium oxide, cobalt blue ($CoO-AI_2O_3$), chrome yellow ($PbCrO_4$), and iron oxide. Suitable organic pigments include, for example, azo pigments including diazo pigments and monoazo pigments, polycyclic pigments (e.g., phthalocyanine pigments such as phthalocyanine blues and phthalocyanine greens), perylene pigments, perinone pigments, anthraquinone pigments, quinacridone pigments, dioxazine pigments, thioindigo pigments, isoindolinone pigments, pyranthrone pigments, and quinophthalone pigments), insoluble dye chelates (e.g., basic dye type chelates and acidic dye type chelate), nitropigments, nitroso pigments, anthanthrone pigments such as PR168, and the like. Representative examples of phthalocyanine blues and greens include copper phthalocyanine blue, copper phthalocyanine green, and derivatives thereof (Pigment Blue 15, Pigment Green 7, and Pigment Green 36). Representative examples of quinacridones include Pigment Orange 48, Pigment Orange 49, Pigment Red 122, Pigment Red 192, Pigment Red 202, Pigment Red 206, Pigment Red 207, Pigment Red 209, Pigment Violet 19, and Pigment Violet 42. Representative examples of anthraquinones include Pigment Red 43, Pigment Red 194, Pigment Red 177, Pigment Red 216 and Pigment Red 226. Representative examples of perylenes include Pigment Red 123, Pigment Red 149, Pigment Red 179, Pigment Red 190, Pigment Red 189 and Pigment Red 224. Representative examples of thioindigoids include Pigment Red 86, Pigment Red 87, Pigment Red 88, Pigment Red 181, Pigment Red 198, Pigment Violet 36, and Pigment Violet 38. Representative examples of heterocyclic yellows include Pigment Yellow 1, Pigment Yellow 3, Pigment Yellow 12, Pigment Yellow 13, Pigment Yellow 14, Pigment Yellow 17, Pigment Yellow 65, Pigment Yellow 73, Pigment Yellow 74, Pigment Yellow 90, Pigment Yellow 110, Pigment Yellow 117, Pigment Yellow 120, Pigment Yellow 128, Pigment Yellow 138, Pigment Yellow 150, Pigment Yellow 151, Pigment Yellow 155, and Pigment Yellow 213. Such pigments are commercially available in either powder or press cake form from a number of sources including, BASF Corporation, Engelhard Corporation, and Sun Chemical Corporation. Examples of black pigments that may be used include carbon pigments. The carbon pigment can be almost any commercially available carbon pigment that provides acceptable optical density and print characteristics. Carbon pigments suitable for use in the present system and method include, without limitation, carbon black, graphite, vitreous carbon, charcoal, and combinations thereof. Such carbon pigments can be manufactured by a variety of known methods, such as a channel method, a contact method, a furnace method, an acetylene method, or a thermal method, and are commercially available from such vendors as Cabot Corporation, Columbian Chemicals Company, Evonik, and E.I. DuPont de Nemours and Company. Suitable carbon black pigments include, without limitation, Cabot pigments such as MONARCH 1400, MONARCH 1300, MONARCH 1100, MONARCH 1000, MONARCH 900, MONARCH 880, MONARCH 800, MONARCH 700, CAB-O-JET 200, CAB-O-JET 300, REGAL, BLACK PEARLS, ELFTEX, MOGUL, and VULCAN pigments; Columbian pigments such as RAVEN 5000, and RAVEN 3500; Evonik pigments such as Color Black FW 200, FW 2, FW 2V, FW 1, FW 18, FW S160, FW S170, Special Black 6, Special Black 5, Special Black 4A, Special Black 4, PRINTEX U, PRINTEX 140U, PRINTEX V, and PRINTEX 140V. The above list of pigments includes unmodified pigment particulates, small molecule attached pigment particulates, and polymer-dispersed pigment particulates. Other pigments can also be selected, as well as mixtures thereof. The pigment particle size is desired to be as small as possible to enable a stable colloidal suspension of the particles in the liquid vehicle and to prevent clogging of the ink channels when the ink is used in a thermal ink jet printer or a piezoelectric ink jet printer.

Specific embodiments will now be described in detail. These examples are intended to be illustrative, and not limited to the materials, conditions, or process parameters set forth in these embodiments. All parts are percentages by solid weight unless otherwise indicated.

EXAMPLES

The blanket is made by the following procedure.

Preparation of Electrospun Non-Woven Fiber Mat

A solution of polyurethane in methyl ethyl ketone (MEK) is loaded into a syringe, which is mounted into a syringe pump. About 20 kv is applied at the spinneret. Fibers with about 1 μm diameter are generated and coated on a silicone coated polyimide substrate. The as-spun fiber mat is set at room temperature overnight and then heat-treated at about 130° C. for 30 min to form the non-woven fiber mat.

Preparation of Blanket Surface Coating

An aqueous dispersion of fluoroplastics resin (e.g., FEP) is flow-coated onto the electrospun non-woven fiber mat. The specifics of the coating conditions are: flow rate is 1.8 ml/min; roll RPM ias 123; coating speed is 2 mm/sec; and the blade y-axis position is 59 mm. The resulting coating is heated in oven at 250° C. for 30 min to form a uniform surface coating with polyurenthane fiber mat filled with FEP.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. An ink jet printer comprising:

a transfer member comprising: a polymer dispersed throughout a non-woven polymer fiber matrix, the non-woven polymer fiber matrix comprising polymer fibers having a diameter of from 5 nm to 50 μm, wherein the polymer fiber matrix has a first surface energy and the polymer has a second surface energy, wherein the difference between the first surface energy and the second surface energy is from 30 $mJ/m^2$ to 5 $mJ/m^2$;

a print head adjacent said transfer member for ejecting aqueous ink droplets onto a surface of the transfer member to form an ink image;

a transfixing station located adjacent said transfer member and downstream from said print head, the transfixing station forming a transfixing nip with the transfer member at said transfixing station; and a transporting device for delivering a recording medium to the transfixing nip, wherein the ink image is transferred and fixed to the recording medium.

2. The ink jet printer of claim 1, wherein the polymer comprises from 5 weight percent to 95 weight percent of the transfer member.

3. The ink jet printer of claim 1, wherein the non-woven polymer fiber matrix comprises from 5 weight percent to 95 weight percent of the transfer member.

4. The ink jet printer of claim 1, wherein the transfer member further comprises conductive particles uniformly distributed along the polymer fibers of the non-woven polymer matrix.

5. The ink jet printer of claim 4, wherein the conductive particles comprise from 0.5 weight percent to 30 weight percent of the transfer member.

6. The ink jet printer of claim 1, wherein the first surface energy is from 30 $mJ/m^2$ to 60 $mJ/m^2$.

7. The ink jet printer of claim 1, wherein the first surface energy is from 25 $mJ/m^2$ to 10 $mJ/m^2$.

8. The ink jet printer of claim 1, wherein the second surface energy is from 30 $mJ/m^2$ to 60 $mJ/m^2$.

9. The ink jet printer of claim 1, wherein the second surface energy is from 25 $mJ/m^2$ to 10 $mJ/m^2$.

10. A transfer member for use in aqueous ink jet printer, the transfer member comprising: a non-woven polymer fiber matrix, the non-woven polymer fiber matrix comprising polymer fibers having a diameter of from 5 nm to 50 μm; a polymer dispersed throughout the non-woven polymer fiber matrix, and conductive particles uniformly distributed along fibers of the non-woven polymer matrix; wherein the polymer fiber matrix has a first surface energy and the polymer has a second surface energy, wherein the difference between the first surface energy and the second surface energy is from 30 $mJ/m^2$ to 5 $mJ/m^2$.

11. The transfer member of claim 10, wherein the polymer comprises from 5 weight percent to 95 weight percent of the transfer member.

12. The transfer member of claim 10, wherein the non-woven polymer fiber matrix comprises from 5 weight percent to 95 weight percent of the transfer member.

13. The transfer member of claim 10, wherein the conductive particles comprise from 0.5 weight percent to 30 weight percent of the transfer member.

14. The transfer member of claim 10, wherein the conductive particles comprise graphene nanoparticles.

15. The transfer member of claim 14, wherein the conductive particles comprise from 0.5 weight percent to 30 weight percent of the transfer member.

16. The transfer member of claim 10, wherein the first surface energy is from 30 $mJ/m^2$ to 60 $mJ/m^2$.

17. The transfer member of claim 10, the first surface energy is from 25 $mJ/m^2$ to 10 $mJ/m^2$.

18. The transfer member of claim 10, wherein the second surface energy is from 30 $mJ/m^2$ to 60 $mJ/m^2$.

19. The transfer member of claim 10, wherein the second surface energy is from 25 $mJ/m^2$ to 10 $mJ/m^2$.

20. An ink jet printer comprising:

a transfer member comprising: a polymer dispersed throughout a non-woven polyurethane polymer fiber matrix, the non-woven polyurethane polymer fiber matrix comprising polyurethane fibers having a diameter of from 5 nm to 50 μm, wherein the polyurethane polymer fiber matrix has a first surface energy and the polymer has a second surface energy, wherein the difference between the first surface energy and the second surface energy is from 30 $mJ/m^2$ to 5 $mJ/m^2$;

a print head adjacent said transfer member for ejecting aqueous ink droplets onto a surface of the transfer member to form an ink image;

a transfixing station located adjacent said transfer member and downstream from said print head, the transfixing station forming a transfixing nip with the transfer member at said transfixing station; and a transporting device for delivering a recording medium to the transfixing nip, wherein the ink image is transferred and fixed to the recording medium.

* * * * *